US005574265A

United States Patent [19]

Falcon

[11] Patent Number: 5,574,265

[45] Date of Patent: Nov. 12, 1996

[54] SWITCH HOUSING INCLUDING EXTENSIBLE EXTERNAL ACTUATOR AND IMPROVED TERMINAL STRUCTURE

[75] Inventor: David E. Falcon, Oak Creek, Wis.

[73] Assignee: Honeywell Inc., Minneapolis, Minn.

[21] Appl. No.: 395,255

[22] Filed: Feb. 28, 1995

[51] Int. Cl.[6] ..... H01H 9/02

[52] U.S. Cl. ..... 200/61.44; 200/302.3

[58] Field of Search ..... 200/61.22, 61.23, 200/61.24, 61.44, 298, 302.1–302.3, 293–297, 299–301, 303–307, 52 R, 329–332.2, 402–472

[56] References Cited

U.S. PATENT DOCUMENTS

| | | | |
|---|---|---|---|
| 2,431,747 | 12/1947 | Fry | 200/302.2 |
| 2,717,941 | 9/1955 | Steiner | 200/302.3 |
| 3,809,837 | 5/1974 | Yoshioka | 200/459 |
| 4,295,017 | 10/1981 | Kashima et al. | 200/330 X |
| 4,902,863 | 2/1990 | Fukuma | 200/445 |
| 5,113,046 | 5/1992 | Hauk | 200/302.3 X |
| 5,164,700 | 11/1992 | Green et al. | 200/61.44 X |

*Primary Examiner*—J. R. Scott

*Attorney, Agent, or Firm*—Peter J. Kinsella; William D. Lanyi

[57] ABSTRACT

A low-cost, easy-to-manufacture and easy-to-use switch enclosure is described. The switch enclosure is comprised of a housing having an interior cavity, an operator opening and a conduit opening. The operator opening permits an external operator to mechanically communicate with an electrical switch, while the conduit opening allows a plurality of external wires to electrically connect to the switch. A cover plate, joined to the housing, encloses the interior cavity.

6 Claims, 4 Drawing Sheets

SWITCH HOUSING INCLUDING EXTENSIBLE EXTERNAL ACTUATOR AND IMPROVED TERMINAL STRUCTURE

BACKGROUND OF THE INVENTION

1. Field of the Invention

This invention relates generally to switch enclosures. More particularly, a low-cost, easy-to-manufacture and easy-to-use switch enclosure is described.

2. Description of the Related Art

Electrical switches are well-known in the art. Most electrical switches are comprised of two or more electrical contacts mounted within an insulating body. In many switches, the contacts extend through the insulating body, thus allowing electrical wires to be easily connected. Within the insulating body, the contacts are arranged so that at least one of the contacts can be moved into and out of contact with the other contact(s) by a suitable mechanical operating mechanism. When the contacts are engaged, electrical current flows from one contact to the other. Disengaging the contacts prevents current flow. Hereinafter, the contacts and the surrounding insulating body will be referred to as an electrical switch.

In many applications, an electrical switch is placed within a switch enclosure, often referred to as a housing. The housing protects the switch, including any wiring connected to the contacts, from environmental conditions and human contact. Typically, the housing is comprised of two parts which, when joined, form an interior cavity which surrounds the electrical switch. The housing also has two orifices. External electrical wires are passed through the first orifice and connected to the electrical switch, while an actuator, for mechanically communicating with the electrical switch, occupies the second orifice.

Previously, the housing has been constructed from metallic materials, such as zinc, which are electrically conductive. Because of the conductivity, prior switches have required an electrical insulator between the switch, with its exposed electrical connections, and the housing. Moreover, an additional wire was needed to ground the housing. This not only increased manufacturing costs, but also complicated device installation.

Often, the internal configuration of the cavity made wiring the switch difficult. Specifically, because the interior cavity did not have sufficient space to house excess wire, technicians had to precisely cut each wire. Unfortunately, the required precision typically increased installation time. Moreover, frequently each wire within the cavity had to be cut to a different length, further complicating the installation procedure.

Terminal screws were often used to connect the wiring to the switch. Unfortunately, terminal screws have two disadvantages. First, they are ill-suited for use with stranded wire, as the torsional force tends to separate the strands. Second, all the wires needed to be disconnected from the terminal screws to replace a malfunctioning switch. Once the switch was replaced, the wires would be reinserted into the terminal screws.

To secure the two halves of the metal housing together, screws were run through mounting holes in both halves. In previous designs, the mounting holes ran through the housing cavity, thus requiring an additional seal to prevent environmental elements from entering the cavity. Frequently, lead washers sealed the mounting holes and secured the screws in place. It was not uncommon for such washers to be crushed, thereby jamming the screw in place.

Finally, previous devices required a jam nut to secure the bushing for the over-travel plunger. Once again, this required extra parts and increased assembly time, thus adding to the cost of the product.

SUMMARY OF THE INVENTION

A low-cost, easy-to-manufacture and easy-to-use switch enclosure is described. The switch enclosure is comprised of a housing having an interior cavity, an operator opening and a conduit opening. The operator opening permits an external operator to mechanically communicate with an electrical switch, while the conduit opening allows a plurality of external wires to electrically connect to the switch. A cover plate, joined to the housing, encloses the interior cavity.

BRIEF DESCRIPTION OF THE DRAWINGS

The present invention will be more completely understood from a reading of the Description of the Preferred Embodiments in conjunction with the drawings, in which.

DESCRIPTION OF THE PREFERRED EMBODIMENTS

Figure 1:
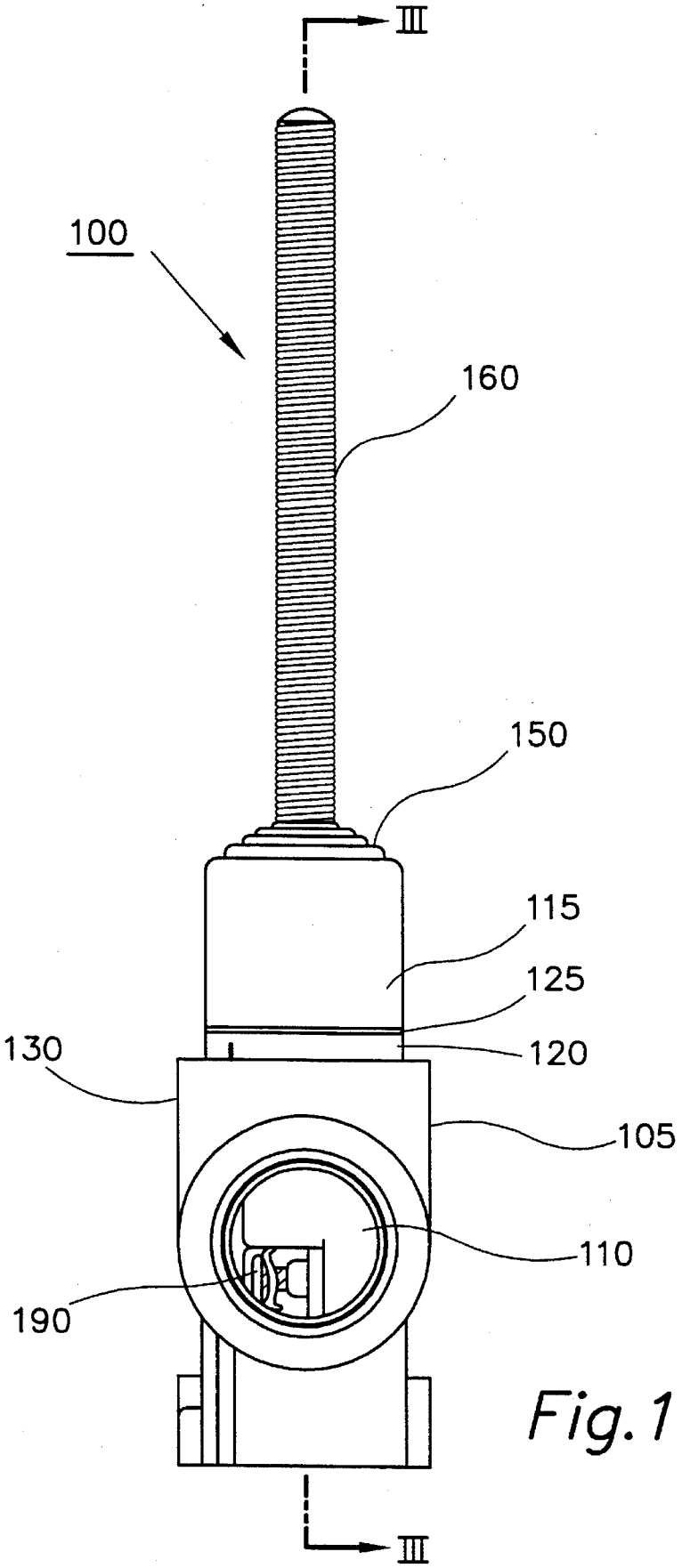
FIG. 1 is a plan view of an enclosed switch.

FIG. 1 is a plan view of an enclosed switch 100. Enclosed switch 100 is comprised of a housing 105, having a boot seat 120, and a cover plate 130. An interior switch cavity 190 is formed when cover plate 130 is joined to housing 105. A conduit opening 110 allows wires (not shown) to pass into internal cavity 190. A wobble stick 160 is connected to an actuating lever 150. A collapsible seal 115 fits over actuating lever 150 and boot seat 120. A retaining ring 125 joins collapsible seal 115 to boot seat 120, thus preventing component separation.

Figure 2:
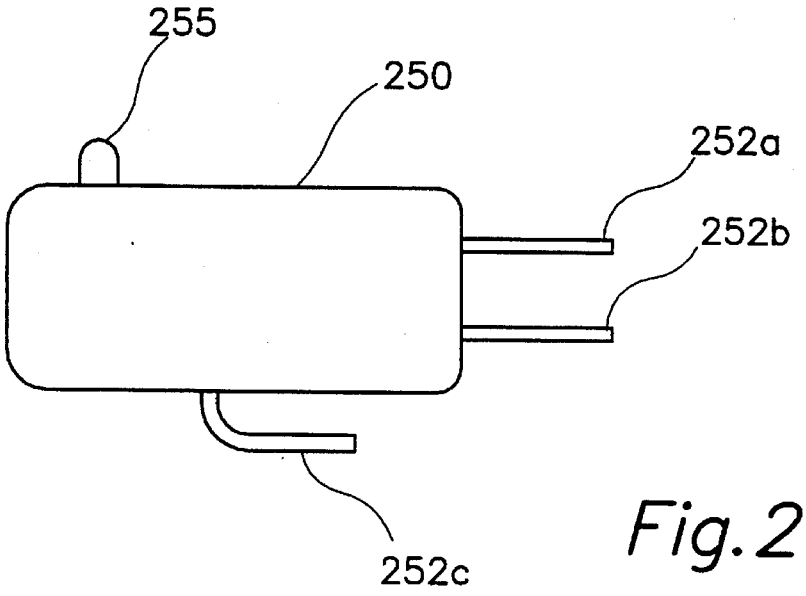
FIG. 2 is a plan view of an electrical switch.

FIG. 2 is a plan view of a switch 250 having a switch actuator 255 and three blades, 252*a*, 252*b* and 252*c*. In the preferred embodiment, switch 250 has two modes of operation. When switch actuator 255 is not depressed, blade 252*a* will be electrically connected to blade 252*c*. When switch actuator 255 is actuated, blade 252*b* will be electrically connected to blade 252*c*.

Those skilled in the art will recognize several switches that operate as described. One such switch, having catalog identification number V3-101, is produced by Micro Switch, a division of Honeywell and available in commercial quantities. It should be noted that switches having electrical operating characteristics other than that described can be utilized with this invention.

Figure 3:
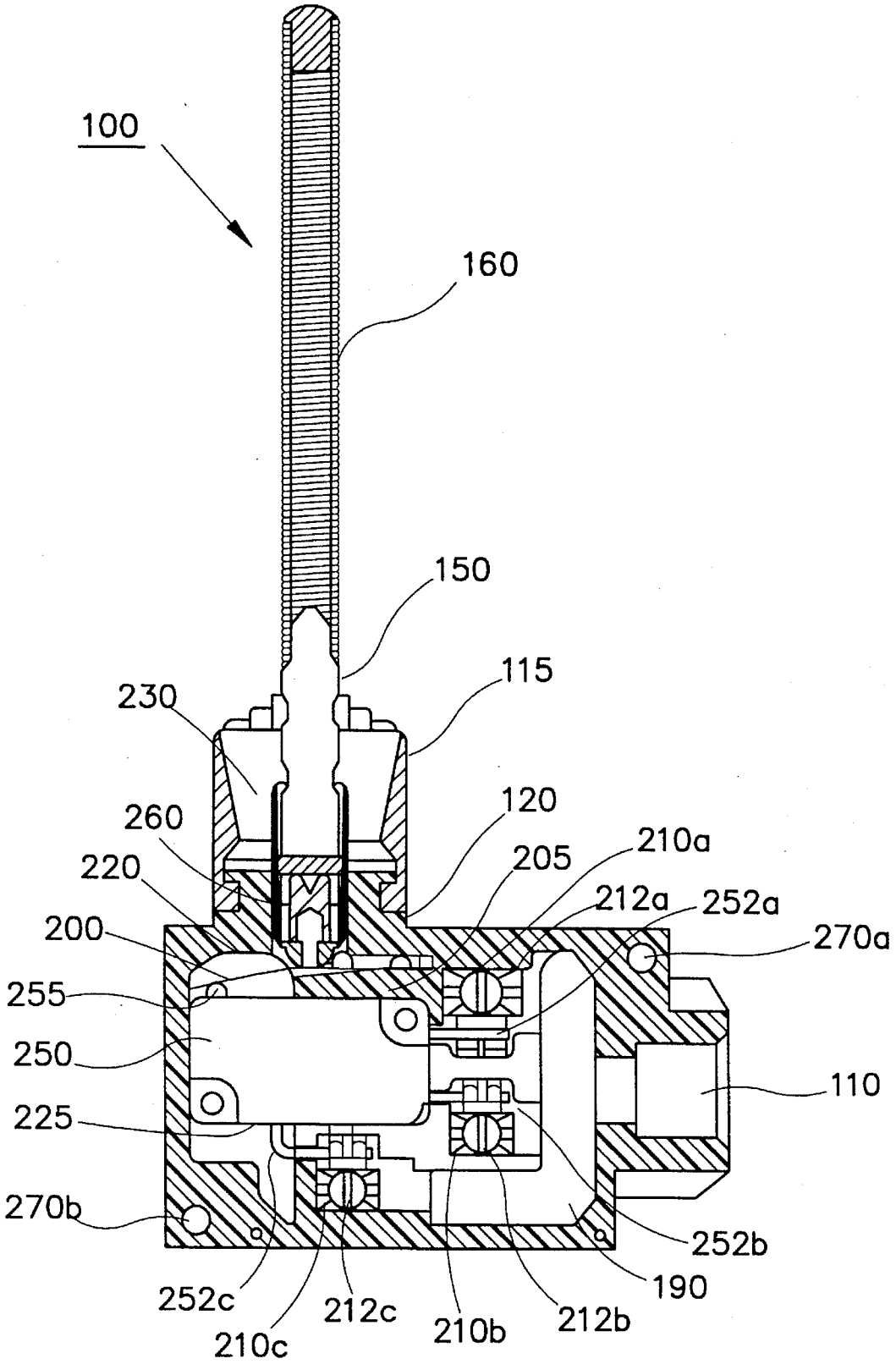
FIG. 3 is a sectional view of the enclosed switch depicted in FIG. 1.

FIG. 3 is a sectional view of enclosed switch 100 taken about sectional line 180, depicted in FIG. 1. Components having the same function as described in FIG. 1 have retained the same numerical designation. As depicted, housing 105 has formed therein a plurality of mounting holes 270*a* and 270*b*, for attaching enclosed switch 100 to an external device (not shown). Mounting holes 270*a* and 270*b* are positioned exterior to internal cavity 190. Housing 105 is further comprised of a spring stop 205 and a plurality of terminal pockets 210*a*, 210*b* and 210*c*, constructed and positioned to form a switch pocket 225. A plurality of terminals 212*a*, 210*b*, and 210*c* are frictionally held within terminal pockets 210*a*, 212*b* and 212*c*, respectively. Terminals 212*a*, 212*b* and 212*c* electrically connect blades 252*a*, 252*b* and 252*c* to wires passing through conduit opening 110 (not shown). A threaded operator opening 260, in boot seat 120, permits a threaded plastic bushing 230 to connect actuating lever 150 to a plunger actuator 220, which is in mechanical communication with a leaf spring 200. Leaf spring 200, in mechanical communication with switch actuator 255, pivots about spring stop 205 when actuating lever 150 is moved.

As described above, housing 105, spring stop 205 and terminal pockets 210*a*, 210*b* and 210*c* form switch pocket 225. The dimensions of switch pocket 225 are chosen to form an interference fit with switch 250. Thus, switch 250 is held in place by friction between switch pocket 225 and switch 250.

In the preferred embodiment, the threads on threaded plastic bushing 230 are deformed to provide prevailing torque when bushing 230 is threaded into operator opening 260. This allows operator opening 260 to keep plastic bushing 230 firmly in place without requiring a jam nut or an equivalent. It should be noted that plastic bushing 230 is less expensive to manufacture than an equivalent metal bushing and jam nut.

Figure 4:
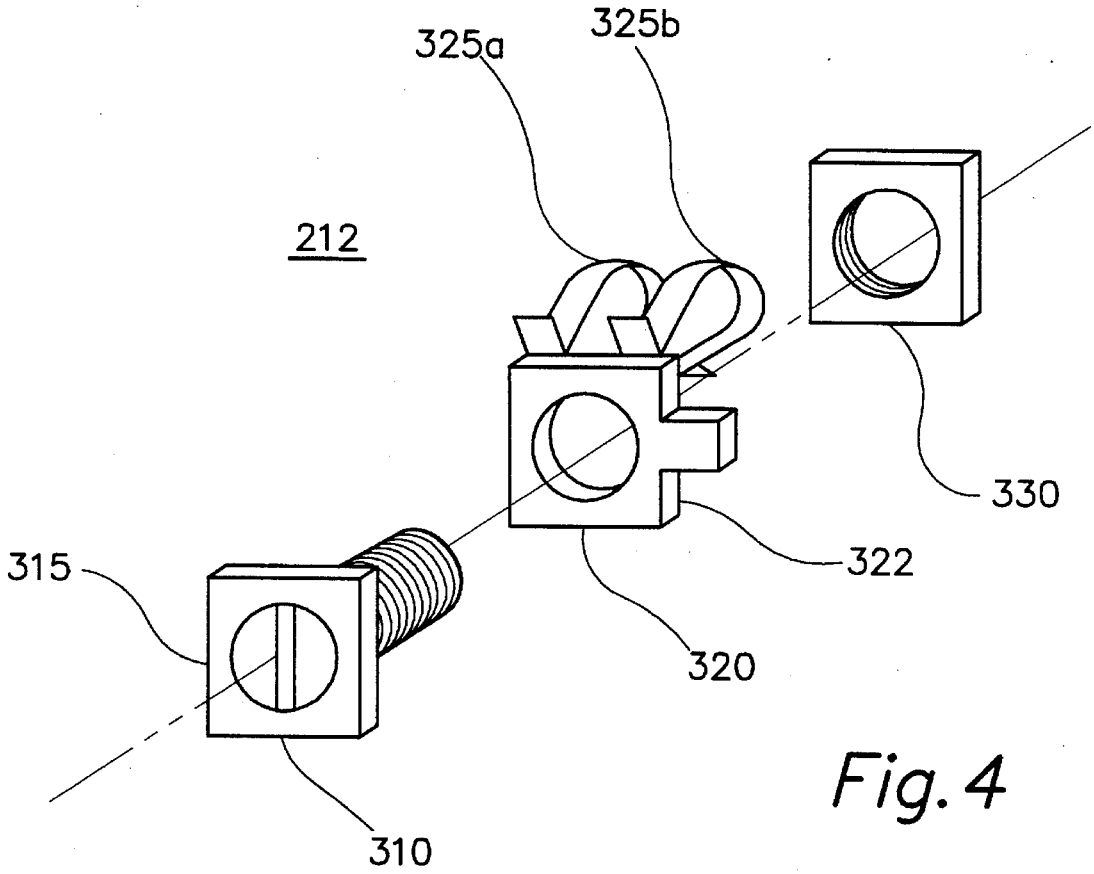
FIG. 4 is a perspective view of a terminal.

FIG. 4 is a perspective view of terminal 212 constructed in accordance with the present invention. Terminal 212 is comprised of an assembled washer screw 310 having a washer plate 315, a nut 330 and a terminal screw 320 having a terminal plate 322 and female blades 325*a* and 325*b*. Female blades 325*a* and 325*b* will frictionally hold blade 252 of switch 250, depicted in FIG. 2. When washer screw 310 is threaded into nut 330, washer plate 315 will exert a force on terminal plate 322. The exerted force is sufficient to firmly hold a wire therebetween.

Ideally, washer screw 310, terminal screw 320, female blades 325 and nut 330 are constructed from electrically conductive materials. Thus, when an exposed electrically conductive wire is clamped between washer screw 310 and terminal screw 320, an electrical path is formed between switch blade 252, female blades 325 and the wire.

Although the present invention has been depicted as having two female blades 325*a* and 325*b*, one should note that a different number of blades can be utilized. Decreasing the number of female blades 325 reduces the amount of electrical contact between female blades 325 and switch blade 252, thus potentially causing an open circuit. As the length of switch blade 325 increases, additional female blades 325 can be added.

Because washer plate 315 exerts a compressive force rather then a torsional force on terminal plate 322, one skilled in the art will recognize that either solid wire or stranded wire can be utilized with this invention. It should also be noted that the size of nut 330 is selected so as to form an interference fit with terminal pocket 210. This allows terminal pocket 210 to frictionally hold terminal 212 in place.

Referring to FIG. 3, the operation of enclosed switch 100 will now be described. When no lateral force is acting on wobble stick 160, leaf spring 200 is biased so that switch actuator 255 is not depressed. A force perpendicular to the longitudinal axis of wobble stick 160 will cause plunger actuator 220 to push leaf spring 200 toward switch 250. If wobble stick 160 is sufficiently displaced, switch actuator 255 will be depressed causing switch 250 to switch.

Figure 5:
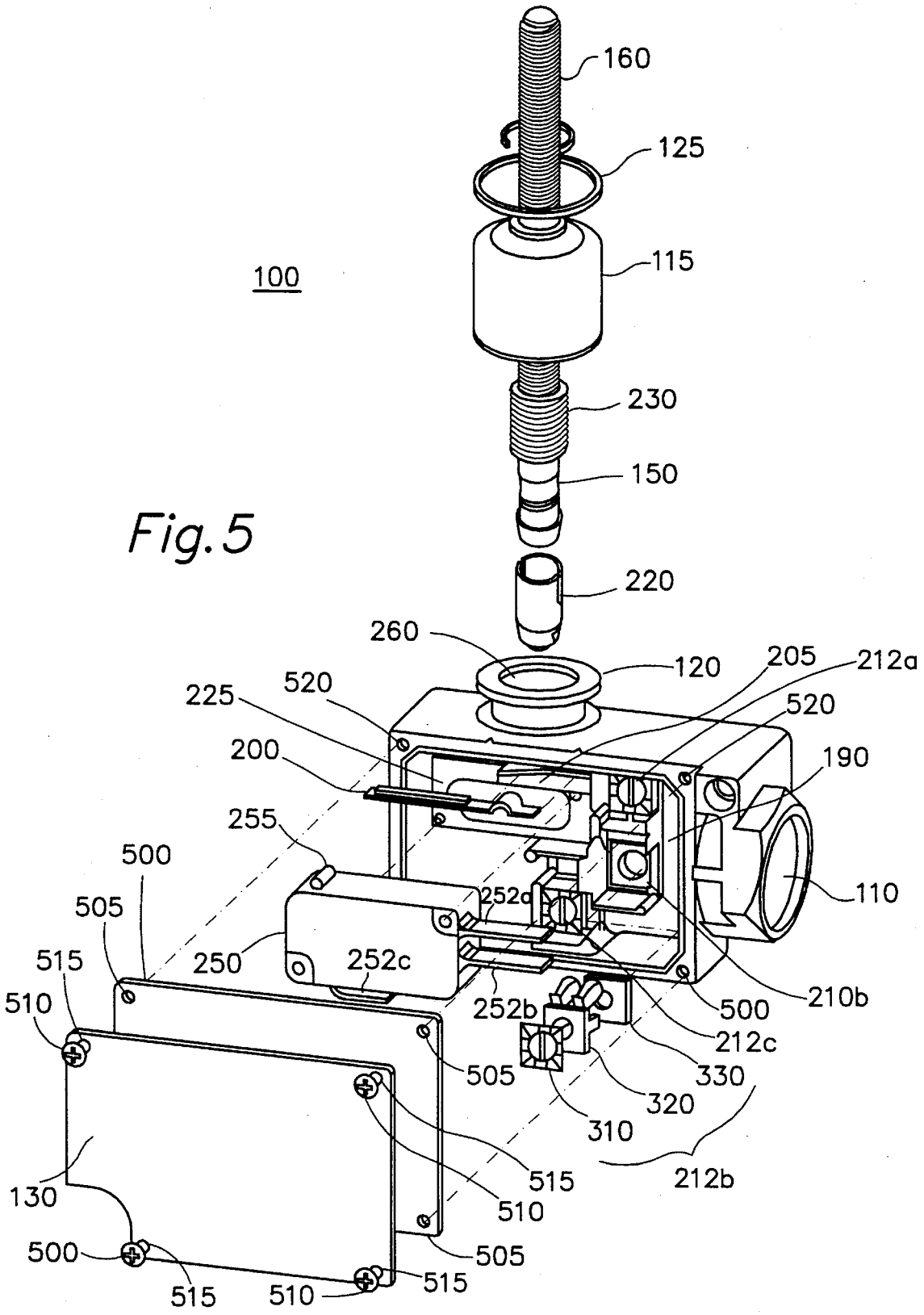
FIG. 5 is a perspective view of the enclosed switch depicted in FIG. 3.

FIG. 5 is a perspective exploded view of enclosed switch 100. Components having the same function as described in previous figures have retained the same numerical designation. As depicted, enclosed switch 100 is further comprised of rubber gasket 500 having gasket screw holes 505. Cover plate 130 has cover plate screw holes 515, while housing 105 has housing screw holes 520. Cover screws 510 secure cover plate 130 and gasket 500 to housing 105.

Gasket 500 prevents environmental elements form entering cavity 190. One skilled in the art will recognize that the exact shape of gasket 500 will be partially determined by the material from which cover plate 130 is constructed. For example, if cover plate 130 is constructed from steel, an electrically conductive material, gasket 150 must prevent any contact between any component within interior cavity 190 from contacting cover plate 130. If, on the other hand, cover plate 130 is constructed from an electrically insulating material, like plastic, gasket 150 does not have to prevent contact between components within interior cavity 190 and cover plate 130.

In the preferred embodiment, cover screws 510 will be captured by gasket 500 because of an interference fit between gasket screw holes 505 and cover screws 510. Thus, when cover screws 510 are removed from housing screw holes 520, cover screws 510 will remain connected to gasket 500. This prevents components from being lost when cover plate 130 is removed.

As described, enclosed switch 100 presents several advantages. First, constructing housing 105 out of a non-conducting plastic eliminates the need for a ground wire and, in some instances, an insulator. This not only reduces manufacturing cost, but also reduces installation time and cost. Second, having a wire clamp, instead of a terminal screw, allows switch 250 to be easily and quickly replaced without having to rewire terminal 212. Third, interior cavity 190 provides sufficient room for extra wire. Thus, wires do not have to be cut to specific lengths, which reduces installation time and cost. Fourth, because the mounting holes are exterior to the cavity, the holes do not have to be sealed from environmental elements, thus eliminating the need for lead washers. This not only reduces component count, but also prevents washers from jamming the holes.

Although the present invention has been described with reference to preferred embodiments, those skilled in the art will recognize changes that may be made in form or detail without departing from the spirit and scope of the invention. For example, FIG. 1 depicts a wobble stick 160 connected to actuating level 150. Those skilled in the art will recognize that wobble stick 160 can be replaced with a variety of other operators, such as a pin plunger or a roller plunger.

Referring to FIG. 2 and FIG. 3, those skilled in the art will recognize other configurations for switch 250 consistent with the spirit and scope of this invention. Particularly, some applications may require switch 250 have only two blades. Such a need may require the repositioning of terminal pockets 210 within interior cavity 190.

Switch 100 can be utilized in a variety of applications. For example, switch 100 could be utilized to activate a "back-up alarm" in construction equipment. Switch 100 can also be utilized in automotive applications, heavy machinery, and vending machines, to name just a few. It should be understood that the applicant does not intend to limit the invention through the foregoing description, but instead define the invention through the claims appended hereto.

I claim:

1. A switch enclosure comprising:

an electrically insulative housing, having an interior cavity, a switch pocket formed within the interior cavity of said electrically insulative housing, said switch pocket being shaped to receive an electrical switch which has a plurality of conductive blades extending therefrom and a switch actuator, an operator opening permitting an external operator to mechanically contact said switch actuator of said electrical switch, and a conduit opening through said electrically insulative housing for allowing a plurality of external wires to be electrically connected to the switch, a plurality of terminal pockets formed within said interior cavity of said electrically insulative housing;

a plurality of terminals, each of said plurality of terminals being disposed in a preselected corresponding one of said plurality of terminal pockets of said electrically insulative housing and retained in place by a frictional fit between each of said plurality of terminals and said corresponding one of said plurality of terminal pockets formed in said electrically insulative housing, each of said plurality of terminals being shaped to receive a preselected one of said conductive blades by a frictional fit therebetween, whereby each of said plurality of terminals retains a corresponding conductive blade of said electrical switch therein by a frictional fit to retain said electrical switch in place within said switch pocket, each of said plurality of conductive blades being held in electrical communication with said corresponding one of said plurality of terminals by said frictional fit therebetween; and a cover plate joined to said electrically insulative housing to enclose said interior cavity.

2. The switch enclosure as recited in claim 1, wherein said housing has at least one mounting hole, external to said interior cavity, for attaching said switch enclosure to an external device.

3. The switch enclosure as recited in claim 1, further comprising a gasket located between said housing and said cover plate.

4. The switch enclosure as recited in claim 1, wherein said cover is metal.

5. The switch enclosure as recited in claim 1, wherein said cover is plastic.

6. The switch enclosure of claim 1, wherein:

said electrically insulative housing is made of plastic.

* * * * *